United States Patent [19]

Sulowski et al.

[11] 4,423,796

[45] Jan. 3, 1984

[54] LADDER CLIMBER'S SAFETY DEVICE

[76] Inventors: Andrew C. Sulowski, 6 Sweet Pea Path, Weston, Ontario, Canada, M9P 3S3; Henry E. Skelton, 50 Alexander St., Apt. #1808, Toronto, Ontario, Canada, M4Y 1B6

[21] Appl. No.: 444,047

[22] Filed: Nov. 23, 1982

[51] Int. Cl.[3] ..... A62B 1/16

[52] U.S. Cl. ..... 182/8; 182/9

[58] Field of Search ..... 182/3, 4, 8, 9

[56] References Cited

U.S. PATENT DOCUMENTS

| | | | |
|---|---|---|---|
| 543,464 | 7/1895 | Brucksch | 182/8 |
| 975,602 | 11/1910 | Becker | 354/269 |
| 1,010,763 | 12/1911 | Hogan | 182/8 |
| 1,171,638 | 2/1916 | Pennington-Hayward | 116/50 |
| 2,886,227 | 5/1959 | Rose et al. | 182/8 |
| 3,417,840 | 12/1968 | Farnsworth, Jr. | 182/8 |
| 3,885,647 | 5/1975 | Acosta | 182/8 |
| 4,130,177 | 12/1978 | Pandolph | 182/8 |
| 4,184,568 | 1/1980 | Hillier | 182/8 |

*Primary Examiner*—R. P. Machado

[57] ABSTRACT

A ladder climber's safety device comprises a pair of manually graspable rung engaging members providing sliding latches for engaging the rungs of a ladder. The rung engaging members are connected to the climber's safety belt and are interconnected with one another by a push-pull cable for effecting latching and unlatching of each rung engaging member alternately in response to unlatching and latching of the other member.

6 Claims, 3 Drawing Figures

LADDER CLIMBER'S SAFETY DEVICE

This invention relates to ladder climbers' safety devices intended for use by linemen and others, such devices being of the type which may be attached to the climber's safety belt or safety harness. Safety devices of this type usually comprise a pair of handle members which are connected to the climber's safety belt or harness by a flexible strap, the handle members being operated alternately to engage and disengage the ladder so that, if the climber should lose his footing, the engaged member will provide an anchor and so prevent him from falling.

A disadvantage of conventional devices of this kind is that the handle members, which must be operated manually, are independently operable and so make it possible for both members to be disengaged from the ladder at the same time, thereby exposing the climber to the risk of a fall. It is an object of the present invention to provide a safety device in which the handle members are interconnected in such a way that they can only be disengaged one at a time, thus affording complete protection to the climber at all times.

A ladder climber's safety device according to the present invention comprises a pair of handle members, each handle member comprising a manually operable rung engaging portion and a latching member cooperating with said rung engaging portion for preventing disengagement thereof from a rung which is engaged, the latching member having an actuating portion engageable with the rung for holding the latching member in a latching position, a connector assembly for attachment to the climber's safety belt or harness, and flexible support means interconnecting the connector assembly with each of said handle members, the flexible support means comprising a push-pull cable having a core element interconnecting said latching members for effecting latching and unlatching of each latching member alternately in response to unlatching and latching of the other.

In order that the invention may be readily understood, one embodiment thereof will now be described, by way of example, with reference to the accompanying drawings. In the drawings.

Figure 1:
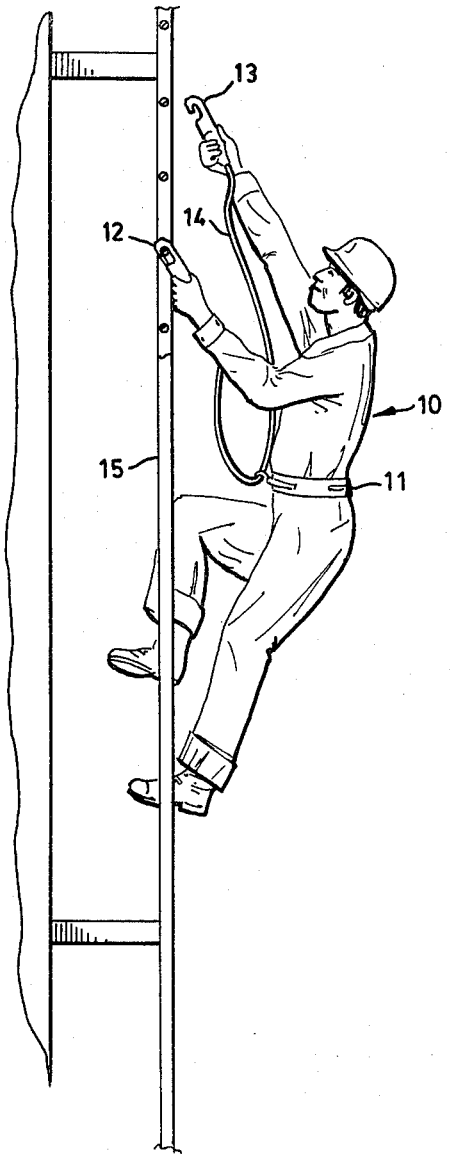
FIG. 1 illustrates the safety device as worn by a climber climbing a vertical ladder.

The safety device worn by the climber 10 (FIG. 1) is attached to the climber's safety belt 11 as hereinafter described. The device comprises essentially a pair of manually graspable handle members 12, 13 which are interconnected with the safety belt 11 and with one another by a flexible cable 14. The handle members are provided with latching means for engaging alternately the rungs of the ladder 15, as shown in FIG. 1.

Figure 3:
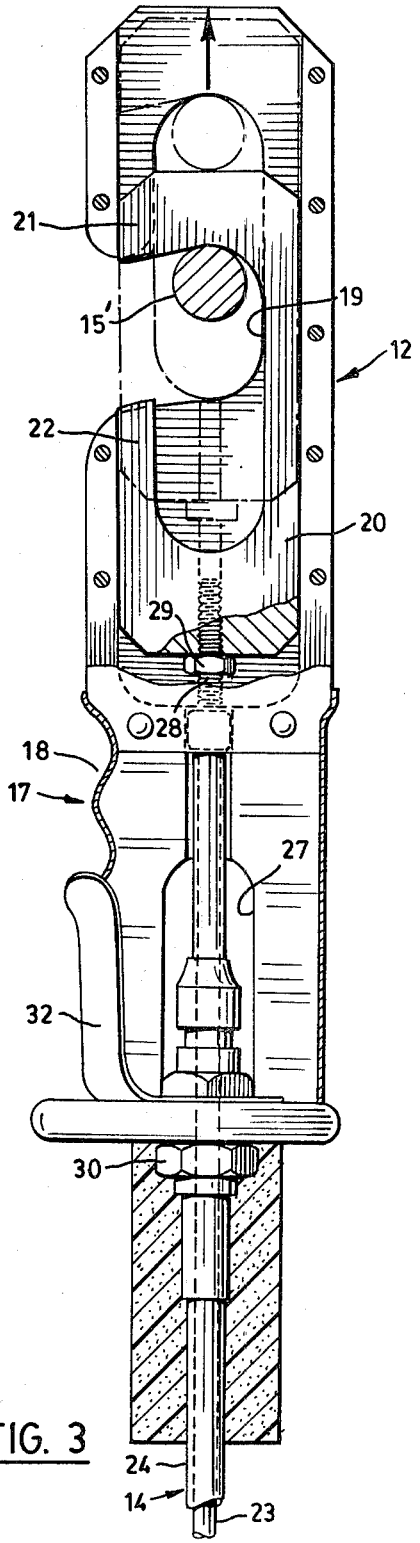
FIG. 3 is a section on line 3—3 in FIG. 2.
Figure 2:
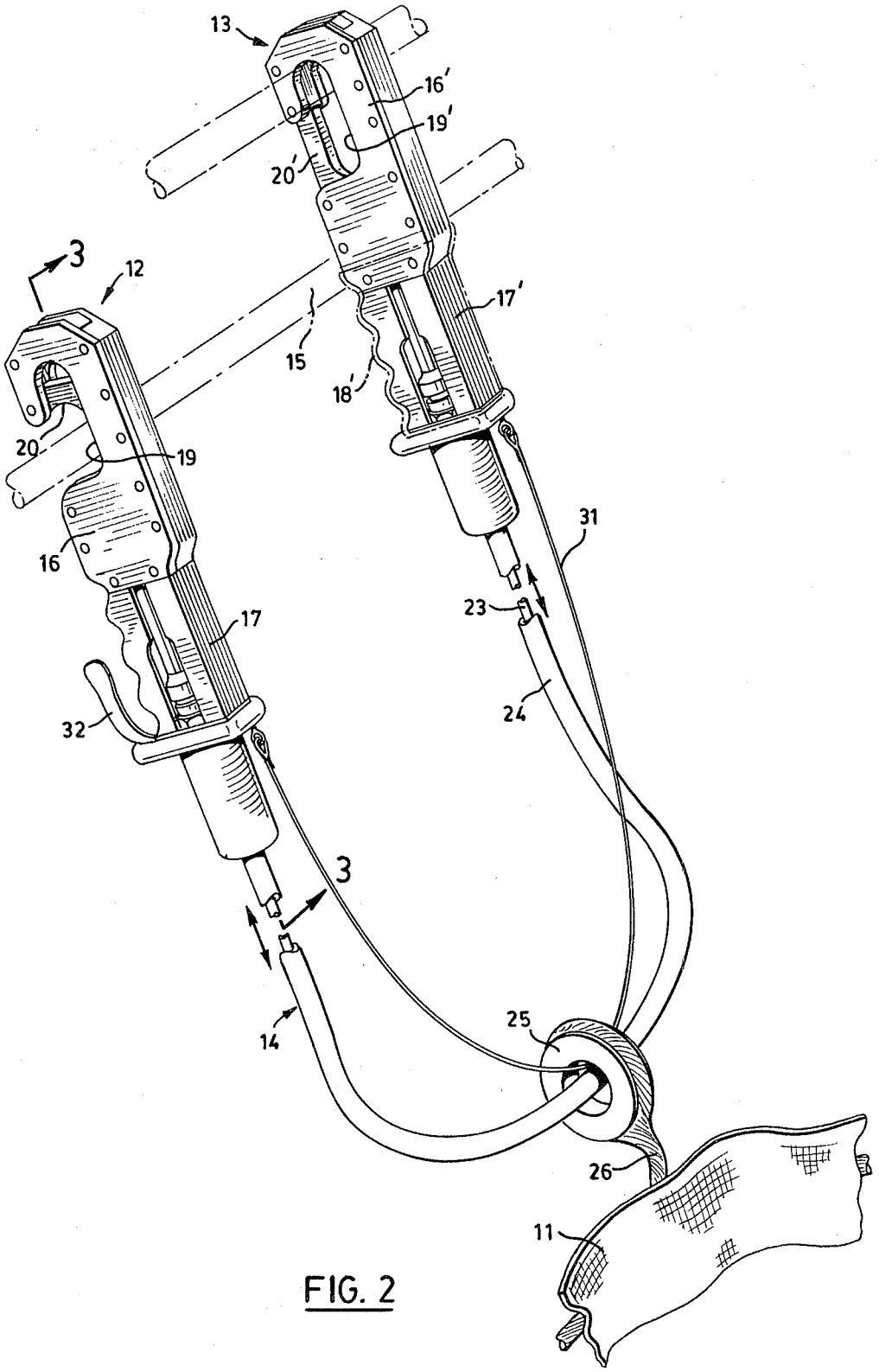
FIG. 2 is a perspective view, partly broken away, of the device.

As shown more clearly in FIGS. 2 and 3, each of the handle members 12, 13 comprises a latching member providing a latch housing 16 (16') in the form of a rigid steel box of generally rectangular cross section having a manually graspable shank 17 (17') extending from its lower end. Each of these shanks is sheathed, as shown in phantom at 18', in a heat shrunk plastic sleeve or a wrapping of tape to improve the climber's grip, and a metal strap 32 shaped to fit the climber's hand is preferably attached to the base of the shank for further assisting his grip. The operative vertical face of each latch housing 16, 16' is recessed, the sides of the housing having reentrant cut-away portions as shown at 19 (19'). The recesses so formed being adapted to receive the rungs of the ladder 15 for latching thereto.

A latching member 20 (20') is slidably mounted within the respective latch housing 16 (16') and is constrained to move linearly therein between latching and unlatching positions. In FIG. 1 the latching member of the handle member 12 is shown in the latching position whereas the latching member of the handle member 13 is shown in the unlatched position. In FIG. 2, however, the latching members 20 and 20' are shown in the unlatched and latching positions respectively.

Referring now to FIG. 3, which shows only the one handle member 12, the latching member 20 is slidable across the recessed face of the latch housing 16 between the latching and unlatched portions. For this purpose the latching member is recessed from one edge so as to provide a pair of opposed hook-shaped portions 21, 22. The hook-shaped portion 22 defines a finger which constitutes a latch for retaining the ladder rung 15' engaged by the handle member when the latching member is in the latching position. The hook-shaped portion 21 of the latching member constitutes an actuating member which is engageable with the rung 15' so that, when the handle member is pulled downwards, the latching member 20 moves upwards into the latching position.

The flexible support 14 comprises a push-pull cable having a core element 23 and a sheath 24. The cable is connected to the safety belt 11 by being freely threaded through a connector ring 25 attached to the safety belt 11 by a cord 26. The shank 17 is formed with a through bore 27 which communicates with the interior of the latch housing 16, the core element 23 extending through the bore and being connected to the latching member 20 by a screw threaded coupling 28, the latter being adjustable by a lock nut 29. The other end of the core element 23 is similarly connected to the other latching member 20'. The ends of the cable sheath 24 are secured by clamping means 30 provided in the shank portions 17 of the handle members. The connections of the push-pull cable at its ends to the handle members are such that one latching member must remain latched while the other is unlatched, and vice versa. The flexible support further comprises a flexible wire rope 31 securely fastened at its ends to the handle members and passing through the connector ring 25. The wire rope 31 is slightly shorter than the cable 14 and thereby serves to reduce wear on the push-pull cable itself. In the event of a fall the wire rope 31, rather than the cable 14, will take the shock load.

As shown in FIG. 1, the flexible support means 14, 31 of the device is connected to the climber's safety belt 11. When using the device the climber grasps the portions 17 of the handle members and engages a rung with one of the latching members as indicated. With the upper latching member so engaged the other latching member is in the unlatched position and can thus be engaged with another rung, i.e. a higher rung when climbing. Upon engaging this other rung the latching member moves to the latching position, thus disengaging the first latching member which thereupon is made ready to engage yet another rung. Thus, by using the handle members alternately to engage the successive rungs, the climber is at all times secured by the engagement of one of the latching members which remains engaged until the other latching member is securely engaged.

What we claim is:

1. A ladder climber's safety device adapted for attachment to a safety belt or harness worn by a climber, comprising:

a pair of handle members, each handle member comprising a manually operable rung engaging portion and a latching member cooperating with said rung engaging portion for preventing disengagement thereof from a rung which is engaged, the latching member having an actuating portion engageable with the rung for holding the latching member in a latching position, a connector assembly for attachment to the climber's safety belt or harness, and flexible support means interconnecting the connector assembly with each of said handle members, the flexible support means comprising a push-pull cable having a core element interconnecting said latching members for effecting latching and unlatching of each latching member alternately in response to unlatching and latching of the other.

2. A ladder climber's safety device according to claim 1, wherein each handle member comprises a latch housing having a manually graspable shank extending therefrom, said latch housing having a recessed face adapted to receive a rung to be engaged, and wherein each latching member is constrained to move linearly within a respective one of said latch housings across the recessed face, the latching member providing first and second hook-shaped portions, said first hook-shaped portion constituting said actuating portion and said second hook-shaped portion constituting a latch for retaining the rung.

3. A ladder climber's safety device according to claim 2, wherein said manually graspable shank is sheathed.

4. A ladder climber's safety device according to claim 1, wherein said flexible support means comprises a single push-pull cable having a sheath attached at its ends to said manually graspable rung engaging portions and a core element connected at its ends to said latching members.

5. A ladder climber's safety device according to claim 4, wherein the connector assembly comprises a ring, the push-pull cable being threaded freely through the ring.

6. A ladder climber's safety device according to claim 5, wherein the flexible support means further comprises a flexible wire rope securely fastened at its ends to said handle members and threaded freely through said ring.

* * * * *